US008528170B2

(12) United States Patent
Clancy

(10) Patent No.: US 8,528,170 B2
(45) Date of Patent: Sep. 10, 2013

(54) ERGONOMIC TOOL HANDLE

(76) Inventor: Brian T. Clancy, Oxford, MI (US)

( * ) Notice: Subject to any disclaimer, the term of this patent is extended or adjusted under 35 U.S.C. 154(b) by 424 days.

(21) Appl. No.: 12/615,065

(22) Filed: Nov. 9, 2009

(65) Prior Publication Data

US 2010/0116103 A1 May 13, 2010

Related U.S. Application Data

(60) Provisional application No. 61/112,484, filed on Nov. 7, 2008.

(51) Int. Cl.
*B25G 1/10* (2006.01)

(52) U.S. Cl.
USPC ..... 16/430; 81/489

(58) Field of Classification Search
USPC ..... 16/430, 110.1, 431, 436; 74/543; 15/143.1; 81/489
See application file for complete search history.

(56) References Cited

U.S. PATENT DOCUMENTS

| | | | | |
|---|---|---|---|---|
| 489,511 | A | 1/1893 | Terpening | |
| 4,038,719 | A * | 8/1977 | Bennett | 16/430 |
| 4,351,528 | A | 9/1982 | Duplin | |
| 4,553,753 | A | 11/1985 | Gibbons | |
| D292,865 | S * | 11/1987 | Scott | D8/10 |
| 4,759,546 | A | 7/1988 | Steele, Jr. | |
| 4,950,013 | A * | 8/1990 | Yonkers | 294/49 |
| 5,482,072 | A | 1/1996 | Cimino | |
| 5,692,265 | A | 12/1997 | Dalury | |
| 5,706,553 | A * | 1/1998 | Riley et al. | 16/111.1 |
| 6,004,234 | A | 12/1999 | Majchrowicz | |
| 6,083,125 | A | 7/2000 | West | |
| 6,248,031 | B1 | 6/2001 | Brodie | |
| 6,364,792 | B1 | 4/2002 | Evanochko | |
| 6,662,406 | B2 * | 12/2003 | Shonfeld et al. | 16/431 |
| 7,096,761 | B2 * | 8/2006 | Schoor | 81/20 |
| 7,264,563 | B2 | 9/2007 | Dahm | |
| 7,288,036 | B2 | 10/2007 | Casasanta, Jr. | |
| 7,553,246 | B2 | 6/2009 | Turzer | |
| 7,568,987 | B2 | 8/2009 | Mayer | |
| 7,836,557 | B2 * | 11/2010 | Baker | 16/430 |
| 8,006,351 | B2 * | 8/2011 | Baker | 16/430 |
| 2005/0223499 | A1 * | 10/2005 | Baker | 7/170 |
| 2005/0241110 | A1 * | 11/2005 | Baker | 16/430 |
| 2010/0120560 | A1 | 5/2010 | Clancy | |

FOREIGN PATENT DOCUMENTS

| | | | |
|---|---|---|---|
| CA | 2208951 | A * | 12/1998 |
| CH | 685149 | | 3/1994 |

* cited by examiner

*Primary Examiner* — William L. Miller
(74) *Attorney, Agent, or Firm* — John A. Artz; Dickinson Wright PLLC

(57) ABSTRACT

A utility tool handle is provided for use with a hand tool shaft. The handle has curved upper and lower surfaces and a curved termination end. The two side surfaces are parallel to each other. The upper surfaces of the handle slants upwardly relative to the longitudinal axis of the hand tool shaft. The lower surface spline is configured to provide a relaxed wrist grip such that the shaft centerline is generally aligned with a user forearm centerline.

18 Claims, 2 Drawing Sheets

ERGONOMIC TOOL HANDLE

CROSS-REFERENCE TO RELATED APPLICATIONS

The present application is a non-provisional of U.S. Application No. 61/112,484 filed Nov. 7, 2008.

TECHNICAL FIELD

The present invention relates generally to a handle for tools or other practical implements, and more particularly concerns a handle providing ergonomic and performance improvements to traditional hand tools.

BACKGROUND

Ever since the mastery of the concept of tools, humanity has sought to improve or augment human performance through the use of external objects. In its original forms, this pursuit was directed towards utility devices such as levers, hammers, and other tools that aided survival and success. The use of tools has continued to assist society in the building and development of new and innovative products.

Recent developments in tools have commonly turned to the development or utilization of electronic substitutes for manual operation. Considerable design effort has been expended to replace basic operations such as driving a nail with complex electronic or hydraulic systems. The principles behind this direction in tool design is the belief that reduction in operator strain is tied to removing operator effort from the action. What the motorized or electric theories fail to address is that many operators do not want to be so removed from the operations they are enacting. Furthermore, the cost and complexity of electronic tools often preclude their usage in many situations. Finally, a pure mechanical tool is always ready, never needs charged or powered, and rarely fails. A new approach towards rethinking traditional design shapes may produce more significant improvements than the application of electronics or motors.

One arena in which traditional utility tools are lacking stems from a failure to apply decades of knowledge of the human body to age old designs. Often the tools retain designs that are offshoots from the simple sticks from which they were originally formed. As such they largely remain straight shafts with only the most minor modifications. Players or other users must grip the straight shaft from the side. This commonly places the users wrist in a strained position which in turn hampers performance and causes undue stress on the user. In addition, a traditional side gripping stance places the centerline of the user's forearm on an angle to the centerline of the engaged shaft. This non-linear grip approach prevents the shaft from acting as a true extension of the users arm. The brain and body must compensate for the lack of linear extension constantly during usage of the shaft. This not only adds undue stress to the operator but also acts a limiter to the true freedom of motion granted to human form.

It would be advantageous to have ergonomic handle design that would allow operators or craftsmen to utilize the tools of their trade with a reduction of stress as well as a more liberal freedom of motion they already experience in their own limbs.

SUMMARY OF THE INVENTION

A utility tool handle is provided for use with a hand tool shaft including an upper shaft surface having an upper shaft plane, a lower shaft surface having a lower shaft plane, two side shaft surfaces having side surface planes and a shaft centerline. The handle includes a shaft engagement end, a handle termination end opposite thereto, an upper handle surface, a lower handle surface comprising a lower surface spline extending inwards from the lower shaft plane towards the upper shaft plane in a first lower handle surface beginning at the shaft engagement end. The lower surface spline extending outwards in the lower shaft plane direction in a second lower handle surface beginning at the first lower handle surface and extending towards the handle termination end. A curved stop element runs between the upper handle surface towards the lower handle surface at the handle termination end and is sized to fit within a human palm. Two handle side surfaces run generally parallel to the two side shaft surfaces. The lower surface spline is configured to provide a relaxed wrist grip such that the shaft centerline is generally aligned with a user forearm centerline.

The present invention has advantages by providing a reduced user stress and increased performance efficiency during operation of the utility hand tool in addition to providing an improved range of motion for the operator. The present invention accomplishes this through a unique shape that aligns the forearm with the operational stick centerline.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION

In the following description, various operating parameters and components are described for one or more constructed embodiments. These specific parameters and components are included as examples and are not meant to be limiting.

Figure 2:
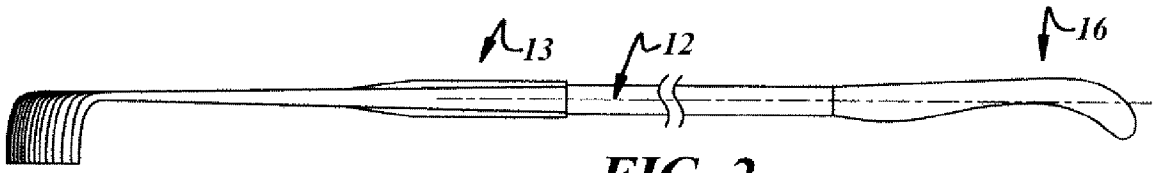
FIG. 2 is a detail illustration of the ergonomic utility tool handle integrated into a rake illustrated in FIG. 1.
Figure 1:
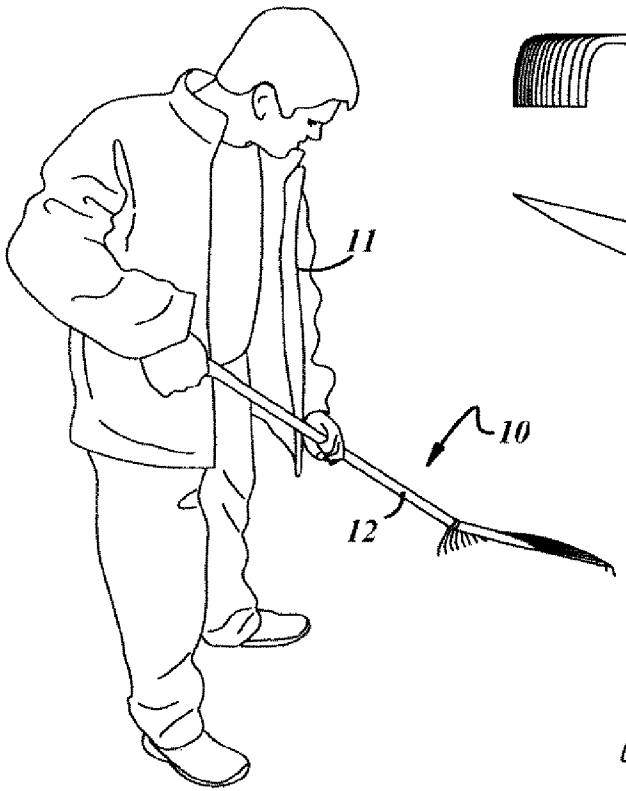
FIG. 1 is an illustration of an ergonomic utility tool handle in accordance with the present invention, the ergonomics utility tool handle illustrated integrated into a rake and gripped by an operator.
Figure 4:
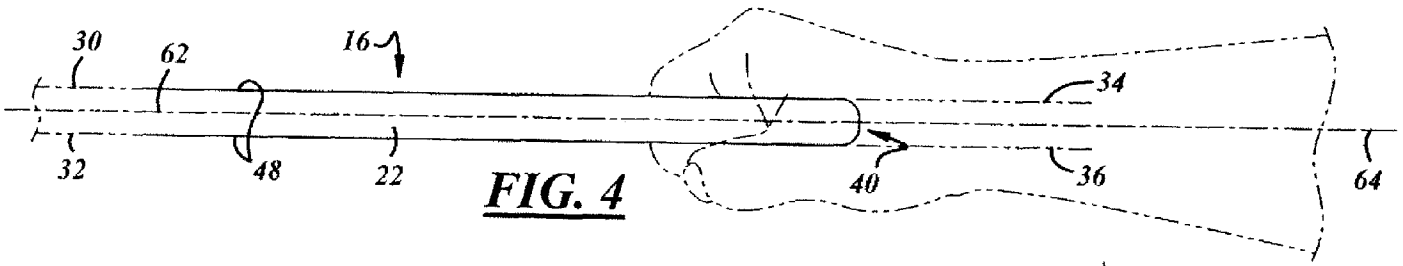
FIG. 4 is an top view of the ergonomic utility tool handle illustrated in FIG. 3.
Figure 5:
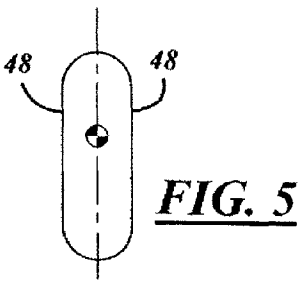
FIG. 5 is an end view of the ergonomic utility tool handle illustrated in FIG. 3.
Figure 3:
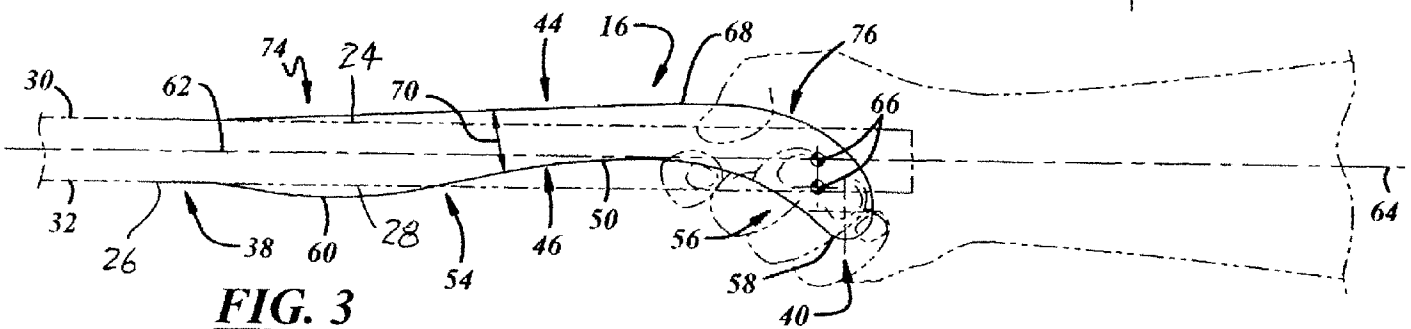
FIG. 3 is an illustration of the ergonomic utility tool handle illustrated in FIG. 1, the ergonomic utility tool illustrated in a center side view.

FIGS. 1 and 2 are illustrations of a utility hand tool 10 in accordance with the present invention, the tool being held by an operator 11 during use. The utility hand tool 10 is illustrated as a rake 13, but as will be understood by way of this disclosure, the present invention is applicable to a wide range of utility hand tools 10. The present invention, however, significantly diverges from known hand tools in that if further includes an ergonomic handle 16. The ergonomic handle 16 may be formed as a unitary piece with the tool 10 or may be formed as an independent element to be added to an existing tool 10. As seen in FIGS. 3 through 5, the ergonomic handle 16 may be comprised of a main handle body 18. The ergonomic handle 16 is intended to integrate with a shaft portion 12 of the utility hand tool 10.

The shaft portion 12 is comprised of a an upper shaft surface 22 having an upper shaft plane 24, a lower shaft surface 26 having a lower shaft plane 28 (FIG. 3) and two side shaft surfaces 30, 32 having side surface planes 34, 36 (FIG. 4). It should be understood that the use of the term planes is for reference purposes and is not intended to limit the shaft portion 12 to flat surfaces. In the case of cylindrical or oval cross-sections it is contemplated that the planes may be referenced by the tangent of the upper most point, the lower most point, and the farthest side points respectively. As can be seen in FIGS. 3 and 4, the shaft surfaces 22,26,30,32 may be extended to provide a reference for the unique configuration of the handle body 18.

The handle body 18 is comprised of a shaft integration end 38 and a handle termination end 40 opposite the shaft integration end 38. The shaft integration end 38 may simply be the end of the handle body 18 wherein it merges into a uniform cross section of the shaft 12 when discussing unitary assemblies. The handle body 18 is further comprised of an upper handle surface 44, a lower handle surface 46 and two handle side surfaces 48. It is contemplated that the lower handle surface 46 is comprised of a lower surface spline 50 extending inwards from the lower shaft plane 28 towards the upper shaft plane 24 in a first lower handle surface portion 54 nearest the shaft integration end 38. In a second lower handle surface portion 56 nearest the handle termination end 40, the lower surface spline 50 extends outwards back away from the upper shaft plane 50 so as to form a concave gripping surface. The lower surface spline 50 ends in a rounded downward protrusion portion 58 that acts as a natural stop feel during performance as well as an end grip. The rounded downward protrusion portion 58 is preferably sized to fit within a human palm such that the utility hand tool 10 does not vary enough from the original shape to pose challenges to operator conventions. In addition, by sizing the downward protrusion portion 58 to fit within a human palm allows an improved gripping position with increased performance and comfort. Although a purely concave lower surface spline 50 may be utilized, it is contemplated that an s-shaped lower surface spline 50 may be utilized such than an initial downward bulge 60 abuts the shaft integration end 38 to act as a lower hand stop during operation. The lower surface spline 50 is configured such that it provides a relaxed wrist grip and such that the shaft centerline 62 is generally aligned with a user forearm centerline 64 (see FIGS. 3 and 4).

It is contemplated that the lower surface spline 50 in the second handle surface portion 56 (along with a complimentary section of the upper surface spline 68) is configured such that the users wrist is rotated less than 20 to 30 degrees (approximately) to reduce strain and improve performance. The rotation angle is preferably determined by measuring the angle of the wrist rotation about the forearm centerline 64 with zero degrees achieved when the palm center 66 is in line with the forearm centerline 64. In addition, the rounded downward protrusion portion 58 engages the approximate palm center 66 when gripped. Although it is contemplated that the palm center 66 will remain close to the forearm centerline 64 in one embodiment, in another it is contemplated to drop approximately 0.5 inches to accommodate a greater wrist angle. Another way to describe the same structure is that the lower surface spline 50 in the second handle surface portion 56 is configured to maintain a wrist rotation of less than 20 or 30 degrees while keeping the forearm centerline 64 parallel with the shaft centerline 62. The first handle surface portion 54 is then configured to move upwards from the shaft centerline 62 until the forearm centerline 64 is approximately in line with the shaft centerline. In still another method of describing the lower surface spline 50 is that the second handle surface portion 56 is configured for proper ease of grip and then the lower surface spline is raised until the shaft centerline 62 and the forearm centerline 64 are approximately aligned. This results in an approximate rise of four degrees of the upper surface spline 68 away from the upper shaft plane 24. These are simply additional ways of describing the unique geometry of the present invention.

It is preferable that the palm center 66 is maintained above or at the lower shaft plane 28. This both relaxes the wrist as well as bringing up the forearm centerline 64 to approximately be in line with the shaft centerline 62. An upper surface spline 68 generally parallels the lower surface spline 50 so as to maintain shaft handle depth 70 to a value suitable for gripping. Therefore the upper surface spline 68 is convex in nature extending away from the upper shaft plane 24 near the shaft integration end 38 and returning to and dropping below the upper shaft plane 24 and the rounded downward protrusion portion 58. The upper surface spline 68 preferably extends from the upper shaft plane 24 in a direction away from the lower shaft plane 26 in a first upper handle surface portion 74 (corresponding to the first lower handle surface portion 54) and extending back in the upper shaft plane 24 direction in a second upper handle surface portion 76 (corresponding to the second lower handle surface portion 56).

The advantage of the present configuration is that it eliminates or minimizes the arc of wrist movement present in conventional handles by moving the rotation center of wrist and forearm to align with the shaft centerline 62. This drastically changes the feel and control during operations such that an previously unknown range of new control is provided. It is contemplated that the downward portion 58 does not protrude below the lower shaft plane 28 by more than the original shaft depth 72 so as to not negatively impact the shaft profile. The rounded downward protrusion portion 58 and the initial downward bulge 60 act as natural stops for the users grip such that the utility hand tool 10 may be passed between hands during operation without concern for loss or proper hand placement. This allows a previously unknown level of ambidextrous operations also never realized before in tools. These advantages along with untold others are provided by this unique and novel ergonomic handle design. It should be understood that a wide variety of modifications would be motivated by the present disclosure.

Figure 6:
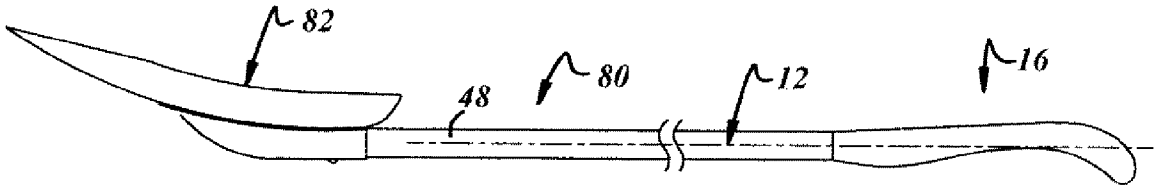
FIG. 6 is an illustration of the ergonomic utility tool handle illustrated in FIGS. 3 through 5, the ergonomic utility tool handle illustrated integrated into a shovel.

Referring now to FIG. 6 which is an illustration of the ergonomic tool handle 16 as integrated into a shovel 80. In this embodiment, it is preferable that the handle upper surface 22 is aligned with the shovel face 82. As will be understood, the shovel 80 is gripped with the rounded downward protrusion 58 towards the ground. Since the shaft centerline 62 is aligned with the forearm centerline 64 as discussed before, the shovel 80 provides improved forward thrust. When utilized with flat handle side surfaces 48 as shown in FIG. 5, the ergonomic tool handle 16 provides a natural and direct connection between the users hand and the angle of the shovel face 82. In this fashion, the operator 11 is constantly aware of the precise angle of the shovel face 82 with relation to his wrist even when transferring the shovel 80 during between hands. This improved adds an additional subconscious orientation and muscle memory during usage.

Figure 7:
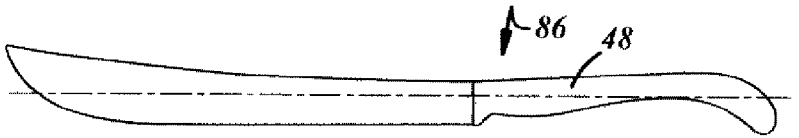
FIG. 7 is an illustration of the ergonomic utility tool handle illustrated in FIGS. 3 through 5, the ergonomic utility tool handle illustrated integrated into a machete.

Referring now to FIG. 7 which is an illustration of the ergonomic tool handle 16 as integrated into a machete 86. The alignment of the shaft centerline 62 with the forearm centerline 64 in addition to the relaxed wrist orientation allows for reduced fatigue and increased performance. In addition when utilized with utilized with flat handle side surfaces 48 as shown in FIG. 5, the ergonomic tool handle 16 provides a natural and direct connection between the users hand and the machete 86. Machetes 86 are typically used for repetitive operations such as harvesting sugar cane. The reduction in fatigue of the forearm provides significant advantages.

Figure 8:
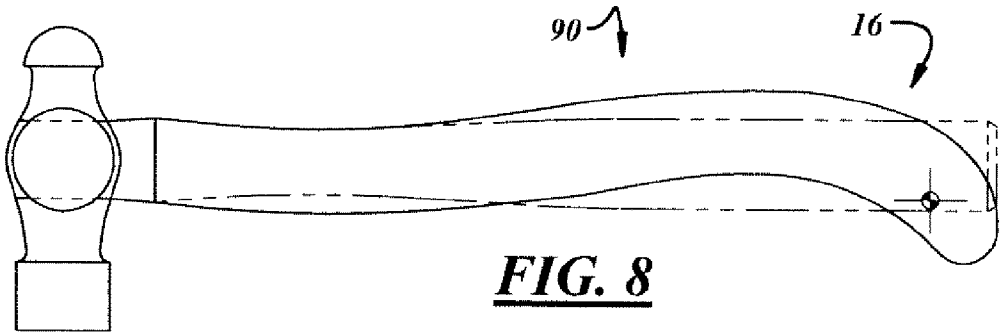
FIG. 8 is an illustration of the ergonomic utility tool handle illustrated in FIGS. 3 through 5, the ergonomic utility tool handle illustrated integrated into a hammer.

Referring now to FIG. 8 which is an illustration of the ergonomic tool handle 16 as integrated into a hammer 90. In this embodiment, it is contemplated that the cross-section of the tool handle 16 will be spherical or elliptical. In this embodiment, it should be understood that the use of the terms shaft planes 24,28, 34, 36 are comprised of a plane formed by the outermost edge point of the hammer 90 in the appropriate direction. The ergonomic handle 16 as applied to the hammer 90 provides carpenters and other operators with reduced fatigue during repetitive motions. In addition, it provides a reduced risk of injury by placing the grip in a natural position during impact. In this fashion, the operators arms are in the most advantageous alignment to provide both maximum force as well as protect against injury.

From the foregoing, it can be seen that there has been brought to the art a new and improved utility tool handle with improved ergonomics. While the invention has been described in connection with one or more embodiments, it should be understood that the invention is not limited to those embodiments. On the contrary, the invention covers all alternatives, modifications, and equivalents as may be included within the spirit and scope of the appended claims.

What is claimed is:

1. An ergonomic tool handle connected to a utility hand tool shaft including an upper shaft surface having an upper shaft plane, a lower shaft surface having a lower shaft plane, two side shaft surfaces having side surface planes, a shaft depth and a shaft centerline, the ergonomic tool handle comprising:

a shaft engagement end;

a handle termination end opposite said shaft engagement end;

a upper handle surface;

a lower handle surface comprising a lower surface spline, said lower surface spline extending inwards uniformly and smoothly in the direction of the lower shaft plane in a first lower handle surface portion beginning at said shaft engagement end, said lower surface spline extending in a direction back towards the lower shaft plane in a second lower handle surface portion beginning at said first lower handle surface portion and extending towards said handle termination end;

an upper surface spline extending uniformly and smoothly from the upper shaft plane in a direction away from the lower shaft plane in a first upper surface portion and extending uniformly and smoothly back in the upper shaft plane direction in a second upper handle surface portion;

an initial downward bulge positioned at said lower handle surface portion to act as a stop for a user's grip;

a rounded downward protrusion portion running between said upper handle surface towards said lower handle surface at said handle termination end; and two handle side surfaces running generally parallel to the two side shaft surfaces;

wherein said upper and lower surface splines are configured to provide an ergonomic wrist grip such that the shaft centerline is generally aligned with a user forearm centerline.

2. The ergonomic tool handle according to claim 1 wherein:

said rounded downward protrusion portion configured to point generally in a lower shaft plane direction, said rounded downward protrusion protruding past the lower shaft plane for a distance less than the shaft depth.

3. The ergonomic tool handle according to claim 1 wherein said shaft engagement end is configured to engage the utility hand tool shaft.

4. The ergonomic tool handle according to claim 1 wherein said rounded downward protrusion portion is sized to fit within a human palm.

5. The ergonomic tool handle according to claim 1 wherein said lower surface spline is configured to generate a wrist rotation of less than 20 degrees when gripped.

6. The ergonomic tool handle according to claim 1 wherein second lower handle surface portion generates a palm center at or above the lower shaft plane.

7. The ergonomic tool handle according to claim 1 wherein said lower surface spline is configured to generate a related wrist grip angle less than 30 degrees and a palm center less than 0.5 inches below the shaft centerline.

8. An ergonomic utility hand tool comprising:

a utility hand tool shaft having a shaft longitudinal axis and including an upper shaft surface having an upper shaft plane;

a utility hand tool member positioned on said shaft, said hand tool member having a head longitudinal axis along its length and a second head axis transverse to said head longitudinal axis, said second head axis in alignment with the shaft longitudinal axis;

a lower shaft surface having a lower shaft plane, said upper shaft plane and said lower shaft plane defining a shaft depth;

two side shaft surfaces having side surface planes; and an ergonomic handle connected to said utility hand tool shaft and having a handle longitudinal axis and comprising:

a shaft engagement end;

a handle termination end opposite said shaft engagement end;

an upper handle surface;

a lower handle surface comprising a lower surface spline, said lower surface spline extending inwards from the lower shaft plane in a first lower handle surface beginning at said shaft engagement end, said lower surface spline extending in the lower shaft plane direction in a second lower handle surface beginning at said first lower handle surface and extending towards said handle termination end;

an upper surface spline extending uniformly and smoothly from the upper shaft plane in a direction away from the lower shaft plane in a first upper surface portion and extending uniformly and smoothly back in the upper shaft plane direction in a second upper handle surface portion;

said handle longitudinal axis remaining between said upper shaft plane and said lower shaft plane substantially along the entire length of said handle;

a rounded downward protrusion running between said upper handle surface towards said lower handle surface at said handle termination end; and two handle side surfaces running generally parallel to the two side shaft surfaces;

wherein said second handle surface portion is configured to provide a relaxed wrist grip and forearm centerline approximately parallel to said shaft longitudinal axis, and said first handle surface portion is configured to raise said user forearm centerline until it is approximately coincident with said shaft longitudinal axis.

9. The ergonomic utility hand tool according to claim 8, wherein said rounded downward protrusion is sized to fit within a human palm.

10. The ergonomic utility hand tool according to claim 8, wherein:

said rounded downward protrusion portion is configured to point generally in a lower shaft plane direction, said rounded downward protrusion protruding past the lower shaft plane for a distance less than said shaft depth.

11. The ergonomic utility hand tool according to claim 8, wherein said lower surface spline is configured to generate a wrist rotation of less than 20 degrees when gripped.

12. The ergonomic utility hand tool according to claim 8, wherein second lower handle surface portion generates a palm center at or above said lower shaft plane.

13. The ergonomic utility hand tool according to claim 8, wherein said first lower handle surface portion includes an initial downward bulge to act as a stop for a user's grip.

14. The ergonomic utility hand tool according to claim 8, wherein said utility hand tool member comprises a hammer head and said utility hand tool shaft comprises a hammer shaft.

15. A utility tool having a tool head, a tool shaft attached to the tool head, and an ergonomic handle connected to the tool shaft, said tool shaft having a longitudinal axis, said ergonomic handle comprising:

a first handle portion attached to said tool shaft, said first portion having a central axis in longitudinal alignment with said shaft longitudinal axis;

a second handle portion at the handle terminal end, said second handle portion curving smoothly in a direction away from said central axis of said first handle portion; and a third handle portion positioned smoothly between said first and second handle portions;

said third handle portion having an upper surface curving smoothly in a first area in a direction away from said first handle portion central axis and curving smoothly in a second area in a direction back toward said first handle portion central axis;

said third handle portion having a lower surface curve smoothly in a first area in a direction away from said first handle portion central axis and curving smoothly in a second area in a direction toward said first handle portion central axis wherein said ergonomic handle is configured to provide a relaxed wrist grip and forearm centerline generally in alignment with the longitudinal axis of the tool shaft.

16. The utility tool according to in claim 15 wherein said tool head is selected from the group consisting of a hammer head, a rake head, a shovel head and a machete head.

17. The utility tool according to claim 15 wherein said tool shaft and said ergonomic handle comprising an integral one-piece member.

18. The utility tool according to claim 17 wherein said tool head is selected from the group consisting of a hammer head, a rake head, a shovel head and a machete tool.

* * * * *